US011125115B2

(12) United States Patent
Humhauser

(10) Patent No.: US 11,125,115 B2
(45) Date of Patent: Sep. 21, 2021

(54) CONNECTING DEVICE FOR A VARIABLE VANE OF A GAS TURBINE

(71) Applicant: MTU Aero Engines AG, Munich (DE)

(72) Inventor: Werner Humhauser, Moosburg (DE)

(73) Assignee: MTU Aero Engines AG, Munich (DE)

( * ) Notice: Subject to any disclaimer, the term of this patent is extended or adjusted under 35 U.S.C. 154(b) by 105 days.

(21) Appl. No.: 16/266,612

(22) Filed: Feb. 4, 2019

(65) Prior Publication Data

US 2019/0249572 A1 Aug. 15, 2019

(30) Foreign Application Priority Data

Feb. 9, 2018 (DE) ..... 102018202082.5

(51) Int. Cl.

| | |
|---|---|
| ***F01D 25/28*** | (2006.01) |
| ***F04D 29/56*** | (2006.01) |
| ***F01D 25/24*** | (2006.01) |
| ***F01D 17/16*** | (2006.01) |

(52) U.S. Cl.

CPC ..... *F01D 25/28* (2013.01); *F01D 17/162* (2013.01); *F01D 25/243* (2013.01); *F04D 29/563* (2013.01); *F05D 2260/36* (2013.01); *F05D 2260/37* (2013.01)

(58) Field of Classification Search

CPC ..... F01D 9/042; F01D 11/22; F01D 25/28; F01D 17/162; F01D 25/243; F04D 29/563; F04D 27/0246; F04D 29/323; F05D 2260/36; F05D 2260/37; F05D 2240/12; F05D 2220/32; Y10T 29/49323

See application file for complete search history.

(56) References Cited

U.S. PATENT DOCUMENTS

| | | | | |
|---|---|---|---|---|
| 5,104,287 | A | 4/1992 | Ciokajlo | |
| 6,146,093 | A | 11/2000 | Lammas | |
| 6,802,692 | B2 | 10/2004 | Bouru | |
| 7,198,461 | B2 * | 4/2007 | Burgmeier | F01D 17/162 415/160 |
| 7,223,066 | B2 * | 5/2007 | Rockley | F01D 17/162 415/160 |
| 8,087,883 | B2 * | 1/2012 | Bouru | F04D 29/563 415/160 |

(Continued)

FOREIGN PATENT DOCUMENTS

| | | |
|---|---|---|
| DE | 4028328 | 3/1991 |
| DE | 60319612 | 4/2009 |

(Continued)

*Primary Examiner* — J. Todd Newton
*Assistant Examiner* — Eric J Zamora Alvarez
(74) *Attorney, Agent, or Firm* — Davidson, Davidson & Kappel, LLC

(57) ABSTRACT

Described is a connecting device (50) for a variable vane (51) of a gas turbine (10), in particular of an aircraft gas turbine, the connecting device including a trunnion element (52) connected to a respective vane (51); a lever element (54) connected to the trunnion element (52), the lever element (54) and the trunnion element (52) being movable together about a trunnion axis of rotation (ZD). It is provided that the lever element (54) and the trunnion element (52) be aligned with each other by a positioning element (68), the positioning element (68) being received in a trunnion receptacle (60) and a lever receptacle (66, 66*a*, 66*b*).

20 Claims, 4 Drawing Sheets

(56) References Cited

U.S. PATENT DOCUMENTS

| | | | |
|---|---|---|---|
| 2004/0240990 | A1 | 12/2004 | Rockley |
| 2008/0031729 | A1 | 2/2008 | Bouru et al. |
| 2010/0092278 | A1 | 4/2010 | Major et al. |
| 2015/0377061 | A1 | 12/2015 | Boeck et al. |

FOREIGN PATENT DOCUMENTS

| | | | |
|---|---|---|---|
| EP | 2177771 | B1 | 4/2017 |
| WO | WO2015/031058 | | 3/2015 |

* cited by examiner

CONNECTING DEVICE FOR A VARIABLE VANE OF A GAS TURBINE

This claims the benefit of German Patent Application DE 10 2018 202 082.5, filed on Feb. 9, 2018 and hereby incorporated by reference herein.

The present invention relates to a connecting device for a variable vane of a gas turbine, in particular of an aircraft gas turbine, the connecting device including a trunnion element connected to a respective vane, and a lever element connected to the trunnion element, the lever element and the trunnion element being movable together about a trunnion axis of rotation.

In the present description, directional words such as "axial," "axially," "radial," "radially," and "circumferential" are taken with respect to the trunnion axis of rotation of the connecting device, unless the context explicitly or implicitly indicates otherwise.

BACKGROUND

In known connecting devices for variable vanes of gas turbines, the trunnion element, in particular its axial end facing away from the vane, is formed with a threaded portion or otherwise modified in shape, for example formed with slopes or the like, to allow the trunnion portion to be connected to the lever element. Examples of this are known from EP 2 177 771 A2 or WO 2015/031058 A1.

Current developments in the field of gas turbines, in particular aircraft gas turbines, are directed toward making geometries, such as flow cross sections, or structures smaller. As a result, variable vanes and the trunnion elements attached thereto also have reduced dimensions. Conventional connecting systems for variable vanes based on, for example, "roof slopes," conical geometries, and the like, require a reduction in the diameter of the trunnion element in an axial end portion thereof. However, this no longer permits the use of bolts or nuts having a common minimum diameter of 0.19 or the size M5 (which has diameter of 0.1969 inches).

SUMMARY OF THE INVENTION

It is an object of the present invention to provide a connecting device that will overcome the above disadvantages.

The present invention provides that the connecting device has a clamping element disposed between the lever element and the trunnion element in such a way that a frictional connection is or can be established between the trunnion element, the clamping element and the lever element. This allows a particularly space-saving design of the vane assembly coupled to the connecting device, because while fastening means can still be used, the vane and its vane trunnion can be dimensioned smaller. Thus, moreover, the clamping element reliably transmits forces between the lever element and the trunnion element, so that the existing actuation principles can also be applied to smaller compressors and turbines having variable stator vanes.

Preferably, the clamping element has a plurality of slots arranged along its circumference such that an elastically flexible clamping portion is formed between respective adjacent slots. In the assembled state, the clamping element may, in particular, be stretched and/or have a bias due to the frictional connection.

At least two diametrically opposite slots in the clamping element may be dimensioned to form a clamping receptacle in which the positioning element is received. Accordingly, when the connecting device is in an assembled state, the positioning element is disposed such that it is located in the clamping receptacle, the trunnion receptacle and the lever receptacle. This advantageously allows the clamping receptacle, the trunnion receptacle and the lever receptacle to be readily aligned with each other without any readjustment being required during assembly.

The clamping portions may be configured to have a conical outer contact surface. The radially inner contact surface of the coupling portion of the lever element and the radially outer contact surfaces of the clamping portions may rest against each other and be clampable against one another.

An advantageous refinement of the present invention provides that the lever element and the trunnion element be aligned with each other by a positioning element in the connecting device, the positioning element being received in a trunnion receptacle and a lever receptacle. Thus, the trunnion receptacle serves as a receptacle for the positioning element in the trunnion element, while the lever receptacle serves as a receptacle for the positioning element in the lever element.

The positioning element may be configured as, for example, a plate-like key. The positioning element serves, in particular, to enable the lever element and the trunnion element to be aligned circumferentially relative to the trunnion axis of rotation. This alignment is performed using the positioning element before the connecting device is tightened. By using a separate positioning element, it is possible to prevent a weakening or change in the diameter of the trunnion element, in particular in regions where forces, in particular torque forces, are transmitted from the lever element to the trunnion element when the connecting device is in the assembled state.

An advantageous refinement provides that the trunnion receptacle and the lever receptacle be disposed in alignment with one another. This makes the positioning element and the respective receptacles particularly easy and inexpensive to manufacture, thus also facilitating assembly. In particular, the positioning element may be configured symmetrically with respect to a plane extending through the trunnion axis of rotation. This also facilitates manufacture and eliminates the requirement of having to observe a mounting orientation of the positioning element.

The trunnion receptacle may preferably be formed in an axial end portion of the trunnion element. This advantageously allows the positioning element to be connected first to the trunnion element during assembly, which facilitates the subsequent mounting of the lever element, in particular its coupling portion, to or on the trunnion element. The trunnion receptacle is configured, for example, as a slot. The slot may have an axial depth slightly greater than the axial extent or height of the positioning element extending through the trunnion receptacle.

For purposes of tightening the connecting device, the clamping element may have a threaded portion onto which a nut is or can be fastened. The threaded portion is disposed at an axial portion of the clamping element that faces away from the trunnion element.

The lever element may have a sleeve-like coupling portion, the coupling portion and the trunnion element being arranged concentrically relative to each other. The coupling portion may, in particular, have a circular configuration. Externally, the coupling portion has a substantially cylindrical shape.

The lever receptacle may be formed in an axial edge portion of the coupling portion. The lever receptacle may be provided by two diametrically opposite lever receptacle sections. The lever receptacle sections may be provided in the edge portion as radially extending slots. When the connecting device is in an assembled state, the positioning element is supported in the lever receptacle sections. In particular, if the trunnion receptacle is disposed in a trunnion end portion, the lever receptacle can be easily slipped over the positioning element, so that it is always possible to precisely align the lever or an additional clamping element, which will be described in more detail below.

The coupling portion may have a radially inner contact surface that is conical in configuration. In particular, the radially inner contact surface faces the trunnion element. For example, the contact surface surrounds the trunnion element, a clearance being present between the contact surface and the trunnion element.

The connecting device may have a retaining sleeve disposed on the coupling portion in the axial direction. The retaining sleeve may have a circumferential rim extending axially slightly beyond the coupling portion of the lever element. This makes it possible to prevent the positioning element from being removed from the connecting device when the connecting device is in the assembled state.

The retaining sleeve may be disposed between the nut and the coupling portion such that a force exerted by the nut in the axial direction is transmitted to the retaining sleeve and the coupling portion. Because of the interaction of the radially inner contact surface of the coupling portion of the lever element with the contact surfaces of the clamping portions, an axial force acting on the coupling portion of the lever element causes the clamping portions to be pressed substantially radially against the trunnion element, so that the trunnion element is frictionally held by the clamping portions.

When the connecting device is in the assembled state, the positioning element may be accommodated such that no forces are transmitted therethrough. By using the clamping element, a frictional connection can be established between the lever element and the trunnion element, the positioning element being used to correctly align the lever element and the trunnion element with each other during assembly. A rotational movement about the trunnion axis of rotation transmitted from the lever element to the trunnion element causes co-rotation of the positioning element, without the positioning element transmitting any forces from the lever element to the trunnion element.

For the sake of completeness, it should be noted that the vanes discussed here may, in particular, be variable vanes of a compressor of the gas turbine.

The present invention further relates to a gas turbine, in particular an aircraft gas turbine, including a plurality of variable vanes, in particular stator vanes, disposed adjacent one another in the circumferential direction of the turbine, each vane having disposed thereon a connecting device according to any of the preceding claims, and the lever elements of the connecting devices being coupled to an actuating ring that is movable along the circumferential direction of the gas turbine.

The variable vanes disposed adjacent one another in the circumferential direction of the turbine may form part of a compressor stage. It is also possible that several such variable vane rings may be provided on a gas turbine, so that in all compressor types, such as low-pressure, medium-pressure and high-pressure compressors, a ring of variable vanes may be provided in any desired compressor stage.

BRIEF DESCRIPTION OF THE DRAWINGS

The present invention will now be described with reference to the accompanying figures by way of example and not by way of limitation.

DETAILED DESCRIPTION

Figure 1:
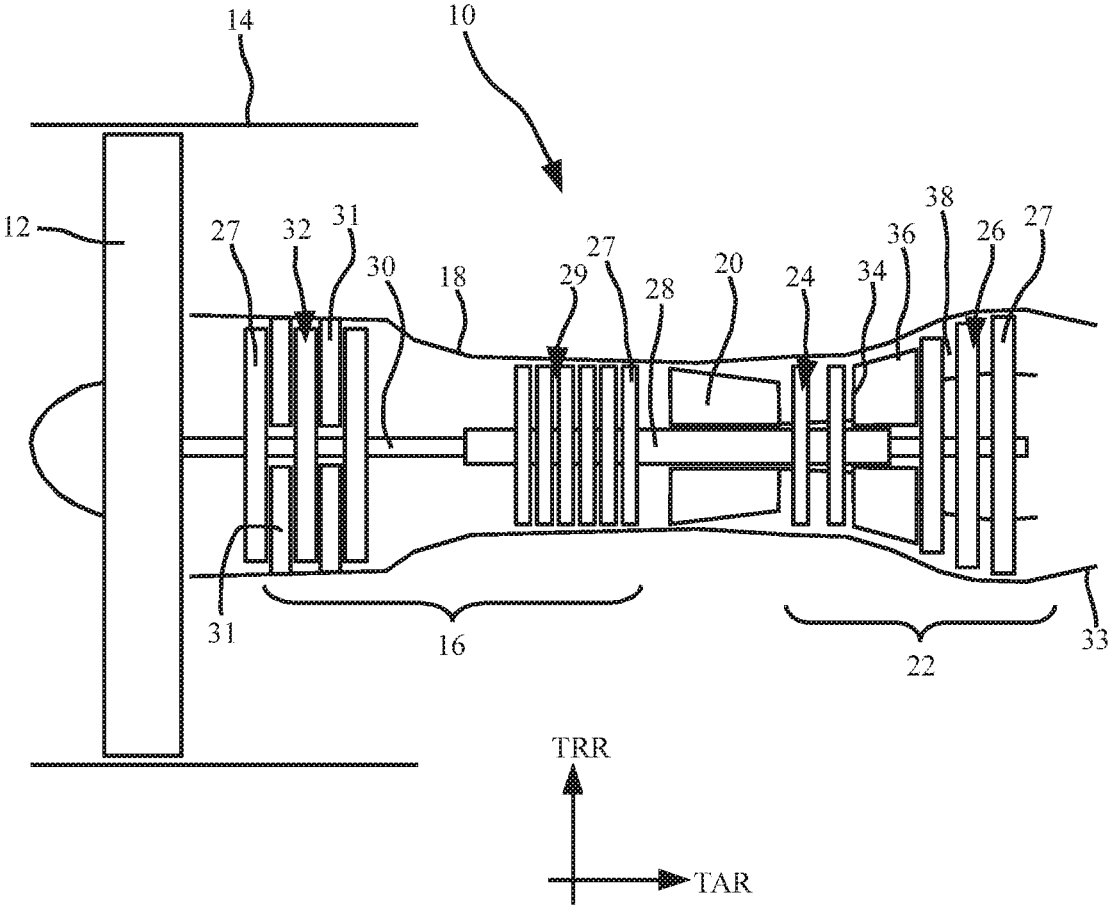
FIG. 1 is a simplified schematic illustration of an aircraft gas turbine.

FIG. 1 shows, in simplified schematic form, an aircraft gas turbine 10, illustrated, merely by way of example, as a turbofan engine. Gas turbine 10 includes a fan 12 that is surrounded by a schematically indicated casing 14. Disposed downstream of fan 12 in axial direction TAR is a compressor 16 that is accommodated in a schematically indicated inner casing 18 and may include a single stage or multiple stages. Disposed downstream of compressor 16 is combustor 20. Hot exhaust gas discharging from the combustor then flows through subsequent turbine 22, which may be single-stage or multi-stage. In the present example, turbine 22 includes a high-pressure turbine 24 and a low-pressure turbine 26. A hollow shaft 28 connects high-pressure turbine 24 to compressor 16, in particular a high-pressure compressor 29, so that they are jointly driven or rotated. Another shaft 30 located further inward in the radial direction TRR of the turbine connects low-pressure turbine 26 to fan 12 and to a here low-pressure compressor 32 so that they are jointly driven or rotated. Disposed downstream of turbine 22 is an exhaust nozzle 33, which is only schematically indicated here.

In the illustrated example of an aircraft gas turbine 10, a turbine center frame 34 is disposed between high-pressure turbine 24 and low-pressure turbine 26 and extends around shafts 28, 30. Hot exhaust gases from high-pressure turbine 24 flow through turbine center frame 34 in its radially outer region 36. The hot exhaust gas then flows into an annular space 38 of low-pressure turbine 26. Compressors 28, 32 and turbines 24, 26 are represented, by way of example, by rotor blade rings 27. For the sake of clarity, the usually present stator vane rings 31 are shown, by way of example, only for compressor 32.

The following description of an embodiment of the invention relates in particular to variable stator vanes which may, for example, form part of an entirely variable stator vane ring 31. Although FIG. 1 exemplarily shows variable stator vane rings 31 only for compressor 32, such variable stator vane rings may also be provided in other compressors or possibly also in turbines.

Figure 2:
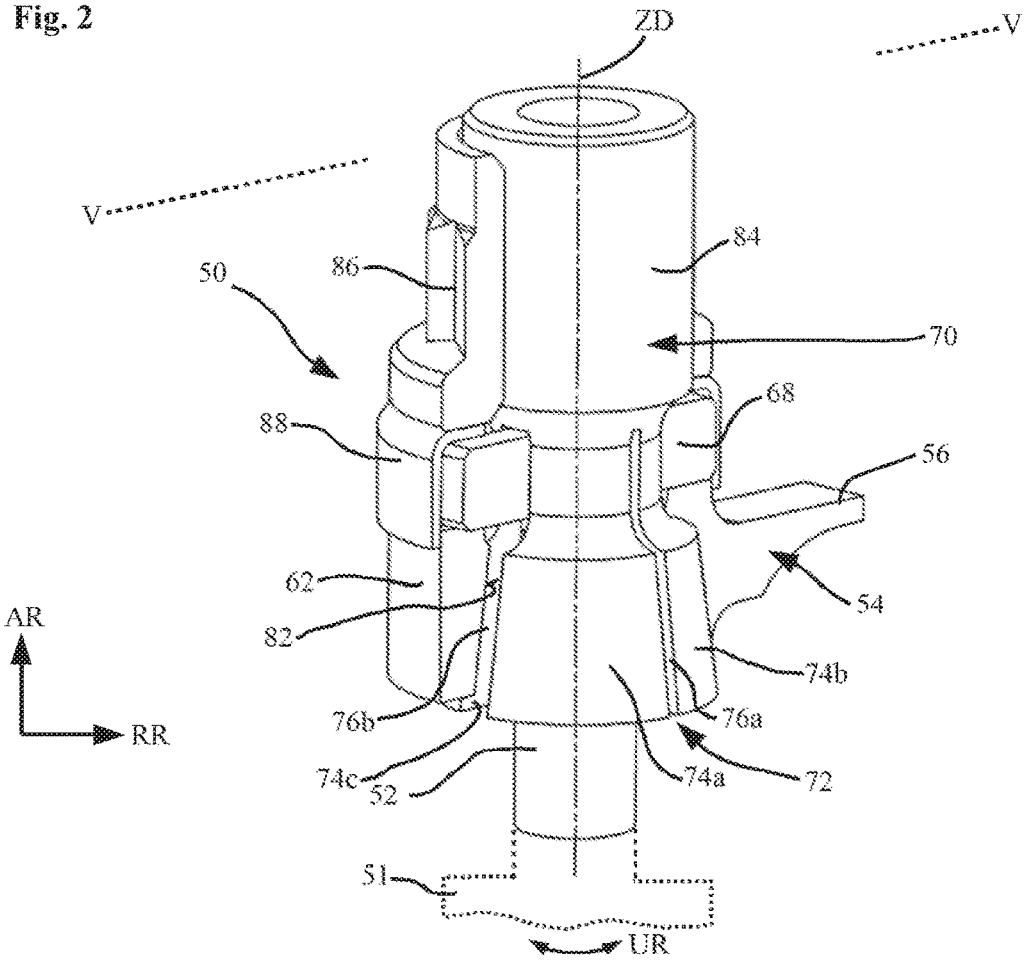
FIG. 2 is a schematic, partially cross-sectional perspective view of a connecting device for a variable vane of a gas turbine.

FIG. 2 shows, in schematic perspective view, a connecting device 50 for a variable stator vane of a gas turbine. Stator vane 51, here only fragmentarily shown in broken line, is adjacent to a trunnion element 52 (only partly shown in FIG.

2) in axial direction AR of connecting device 50. Trunnion element 52 and the vane 51, in particular stator vane, associated therewith are typically integrally connected as one piece.

Connecting device 50 includes a lever element 54. In FIG. 2 (and in FIG. 3), lever element 54 is shown only partially and cut off at 56. Lever element 54 is adapted to rotate trunnion element 52 about the trunnion axis of rotation ZD when connecting device 50 is in an assembled state, the trunnion axis of rotation being parallel to axial direction AR.

Figure 3:
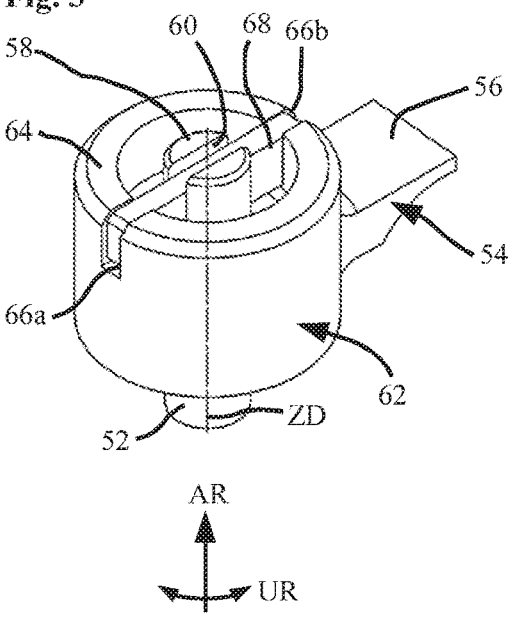
FIG. 3 is a schematic perspective view showing a lever element, a positioning element and a trunnion element of the connecting device of FIG. 2.

It can be seen from FIG. 3 that trunnion element 52 has a trunnion receptacle 60 at its axial end 58 facing away from vane 51. The trunnion receptacle is configured in particular as a slot. Lever element 54 has a sleeve-like coupling portion 62. Coupling portion 62 and trunnion element 52 are arranged in particular concentrically relative to each other. An axial edge portion 64 of coupling portion 62 has a lever receptacle 66 formed therein. Lever receptacle 66 is provided, in particular, by two diametrically opposite lever receptacle sections 66*a*, 66*b*.

A positioning element 68 is received in lever receptacle 66 and trunnion receptacle 60. Positioning element 68 serves to align trunnion element 52 and lever element 54 with each other relative to circumferential direction UR of connecting device 50. For this purpose, in particular, lever receptacle 66; i.e., lever receptacle sections 66*a*, 66*b*, and trunnion receptacle 60, are oriented in alignment with each other so that positioning element 68 is accommodated in lever receptacle 66 and trunnion receptacle 60. Positioning element 68 is configured, in particular, as a plate-like or flat-bar-like component. Positioning element 68 may also be referred to as a key.

Figure 4:
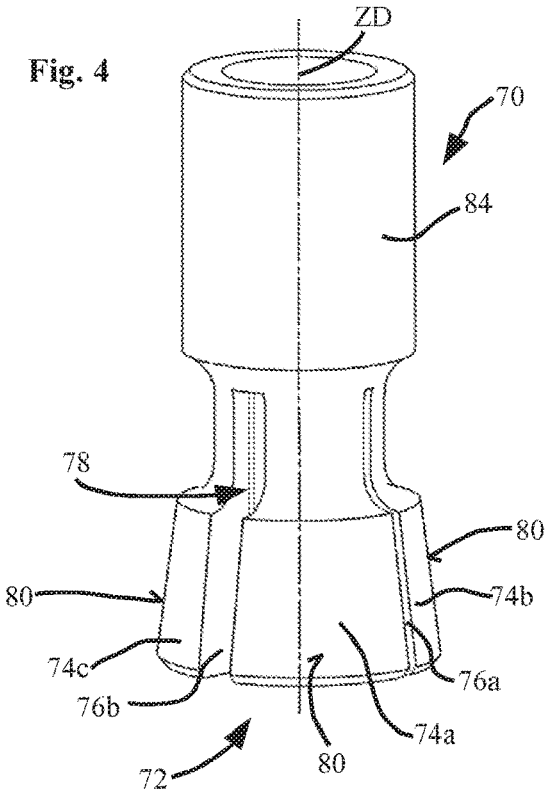
FIG. 4 is a schematic perspective view showing a clamping element of the connecting device of FIG. 2.

Connecting device 50 further includes a clamping element 70, which is shown alone in FIG. 4 and in conjunction with other components of connecting device 50 in FIG. 2. Clamping element 70 has a plurality of clamping portions 74*a*, 74*b*, 74*c* at its axial end 72 facing the vane 51. In the example shown, clamping element 70 has four clamping portions, of which only the three clamping portions 74*a*, 74*b*, 74*c* are visible in FIGS. FIGS. 2 and 4. It should be noted that clamping element 70 could have a different number of clamping portions, such as six or eight clamping portions.

A slot 76*a*, respectively 76*b*, is provided between each two adjacent clamping portions 74*a*, 74*b* and 74*a*, 74*c*, respectively. Clamping portions 74*a*, 74*b*, 74*c* are elastically flexible or deflectable in particular in the radial direction, in particular toward or away from trunnion element 52. Slot 76*b* and another, diametrically opposite slot (not visible in the view of FIG. 4 are dimensioned to form a clamping receptacle 78 in which positioning element 68 can be received during the assembly of connecting device 50 and is received when connecting device 50 is in the assembled state.

Clamping portions 74*a*, 74*b*, 74*c* each have an outer contact surface 80. contact surfaces 80 are conical in configuration along axial direction AR. In other words: clamping element 70 has a variable diameter in the region of its clamping portions 74*a*, 74*b*, 74*c*. When connecting device 50 is in an assembled state, outer contact surfaces 80 are in contact with a radially inner contact surface 82 of lever element 54. Radially inner contact surface 82 is located, in particular, in the region of coupling portion 62. Furthermore, radially inner contact surface 82 may be conical in configuration. Accordingly, the sleeve-like coupling portion 62 has a variable inner diameter in the region of inner contact surface 82.

Radially outer contact surface 80 of clamping portions 74*a*, 74*b*, 74*c* and radially inner contact surface 82 of coupling portion 62 are complementary to each other. The inner diameter or inner radius of coupling portion 62 and the outer diameter of all clamping portions 74*a*, 74*b*, 74*c* or the outer radius of clamping portions 74*a*, 74*b*, 74*c* increase toward vane 51 (FIG. 2).

Clamping element 70 has a threaded portion 84 axially adjacent the clamping portions 74*a*, 74*b*, 74*c*. Threaded portion 84 has an external thread (not shown in FIGS. 2 and 4. A nut 86 is connectable or connected to threaded portion 84, as illustrated in FIG. 2). When connecting device 50 is in the assembled state, a retaining sleeve 88 is disposed axially between nut 86 and lever element 54, or more specifically between nut 86 and coupling portion 62. A force exerted by nut 86 in axial direction AR is transmitted to retaining sleeve 88 and coupling portion 62. The axially acting clamping force of nut 86 causes conical inner contact surface 82 of coupling portion 62 to be pressed against the conical outer contact surface 80 of clamping element 70. As a result, clamping portions 74*a*, 74*b*, 74*c* are pressed radially inwardly against the trunnion portion. Accordingly, upon tightening nut 86, a frictional connection (clamping action) is produced between lever element 54 and trunnion portion 52 by means of clamping element 70.

Figure 5:
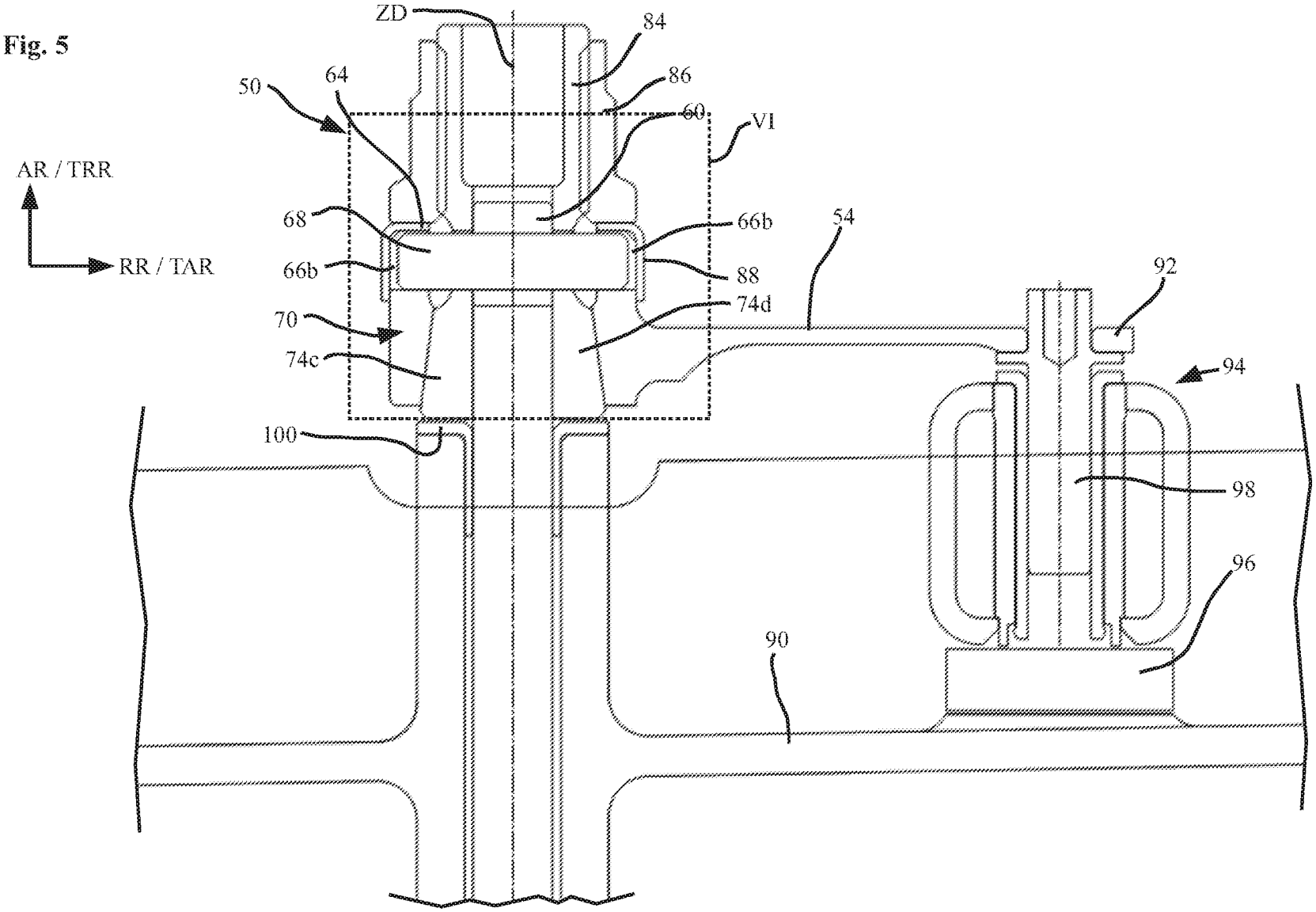
FIG. 5 is a schematic cross-sectional view taken substantially along line V-V of FIG. 2 and showing a portion of a gas turbine including a connecting device and an actuating ring associated therewith.

The assembled state of connecting device 50 shown in FIG. 2 is illustrated in FIG. 5 in a cross-sectional view taken substantially along line V-V of FIG. 2. In this cross-sectional view of FIG. 5, connecting device 50 is mounted in an outer region of structural components 90 of a gas turbine (FIG. 1), in particular an aircraft gas turbine. Structural components 90 may, for example, be part of an inner casing 18, as illustrated in FIG. 1. In FIG. 5, the same reference numerals are used as in FIGS. 2 through 4 to refer to the same elements, even though they are not necessarily described again with reference to FIG. 5. In this respect, it should be appreciated that the preceding description of FIGS. 2 through 4 can also be read and understood in conjunction with FIG. 5.

In FIG. 5, lever element 54 is shown entirely (not cut off). Lever element 54 has a further coupling portion 92 it its end facing away from connecting device 50. Coupling portion 92 is connected to an actuating device 94. Actuating device 94 includes an actuating ring 96 and a plurality of actuating trunnions 98. Actuating trunnions 98 and actuating ring 96 are movable back and forth along a circumference of the turbine. This translational movement along the circumferential direction of the turbine causes lever element 54 to pivot about axis of rotation ZD of trunnion element 52. This allows a vane 51 connected to trunnion element 52 (FIG. 2) to be rotated to the desired position.

Clamping element 70 of connecting device 50 rests on a guide sleeve 100. In this example, the guide sleeve provides a radial bearing for trunnion element 52. With regard to the gas turbine, the axial direction AR of the connecting device corresponds to a radial direction TRR of the gas turbine.

Figure 6:
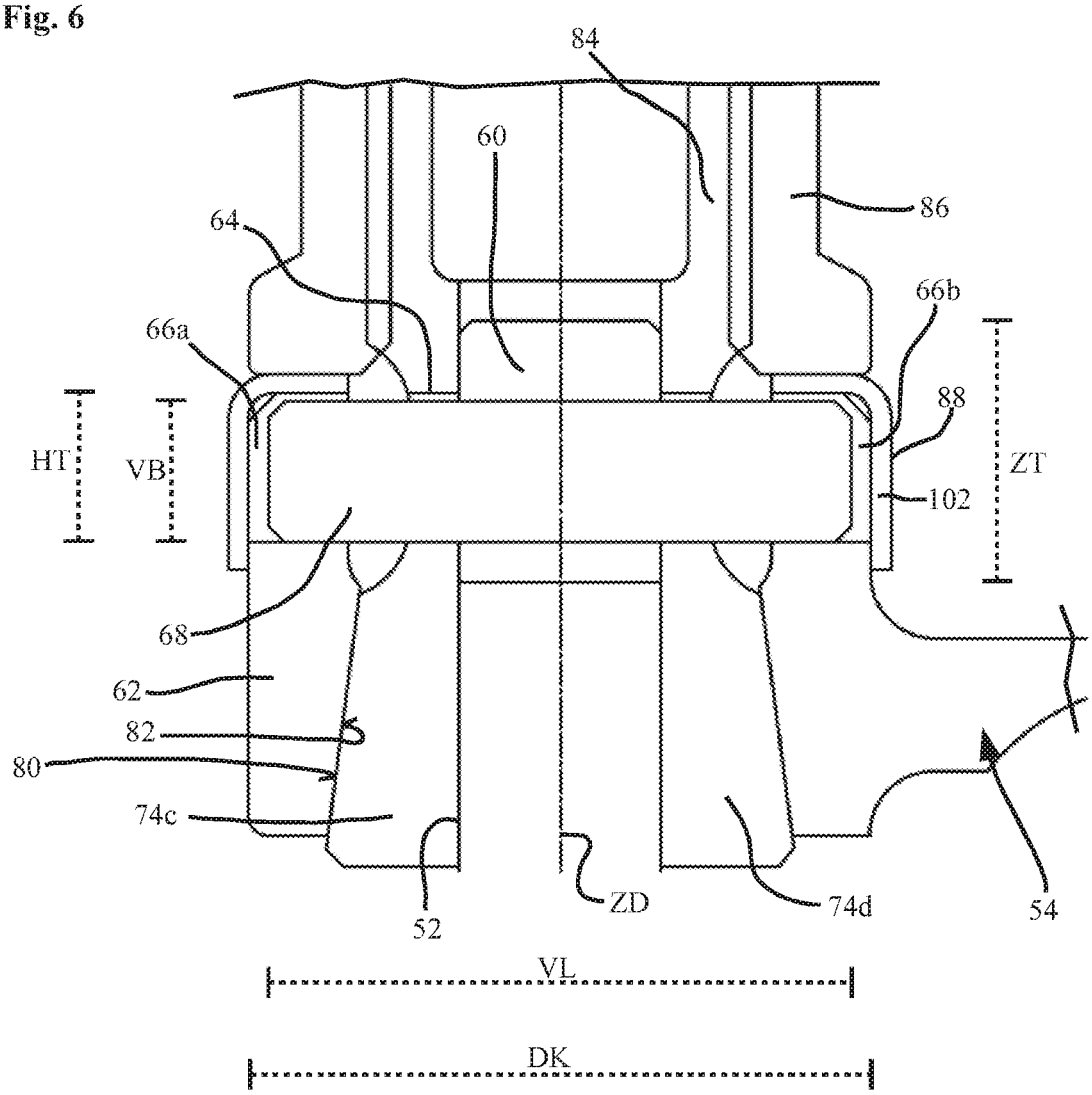
FIG. 6 is an enlarged view of the portion VI surrounded by a broken line in FIG. 5.

FIG. 6 shows an enlarged view of substantially the broken-line portion VI in FIG. 5. FIG. 6 serves in particular to illustrate the relative proportions of positioning element 68 and the other elements.

Positioning element 68 has a length VL in radial direction RR relative to connecting device 50. Length VL of positioning element 68 is selected to be slightly smaller than diameter DK of the substantially circular coupling portion 62 or than the outer diameter of axial edge portion 64, which is annular in configuration. Positioning element 68 has a width VB that is smaller than the axial extent or depth ZT of trunnion receptacle 60. Furthermore, width VB of positioning element 68 is also selected to be smaller than the axial extent or depth HT of lever receptacle 66 or of the individual lever receptacle sections 66*a*, 66*b*.

Retaining sleeve 88 has an edge portion 102 having an axial length greater than the width of positioning element 68. Edge portion 102 rests with its axially lower end against an outer periphery of coupling portion 62. In this way, it is ensured that positioning element 68 cannot be removed from connecting device 50 in the radial direction.

It can be inferred from the relative proportions of positioning element 68 and the other elements of connecting device 50 that when connecting device 50 is in the assembled state, positioning element 68 is accommodated such that substantially no forces are transmitted therethrough. In particular, positioning element 68 does not transmit to trunnion element 52 any rotational movements introduced by lever element 54. The forces exerted by nut 86 and acting in axial direction AR are transmitted via retaining sleeve 88, lever element 54 or its coupling portion 62 to clamping element 70 or its clamping portions 74*a* through 74*d*, so that clamping portions 74*a* through 74*d* are pressed against trunnion element 52. Positioning element 68 is dimensioned such that, during assembly of connecting device 50, it allows trunnion element 52, lever element 54 and clamping element 70 to be correctly positioned relative to each other, particularly in circumferential direction UR of connecting device 50, but such that it is not included in the force-transmission path when a frictional connection is established between lever element 54 and trunnion element 52 in the assembled state of connecting device 50.

LIST OF REFERENCE NUMERALS

10 aircraft gas turbine
12 fan
14 casing
16 compressor
18 inner casing
20 combustor
22 turbine
24 high-pressure turbine
26 low-pressure turbine
27 rotor blade ring
28 hollow shaft
29 high-pressure compressor
30 shaft
31 stator vane ring
32 low-pressure compressor
33 exhaust nozzle
34 turbine center frame
36 outer region
38 annular space
50 connecting device
51 vane
52 trunnion element
54 lever element
56 region of the cut-off lever element
58 axial end of the trunnion element
60 trunnion receptacle
62 coupling portion
64 axial edge portion
66 lever receptacle
66*a/b* lever receptacle section
68 positioning element
70 clamping element
72 axial end
74*a-d* clamping portion
76*a/b* slot
78 clamping receptacle
80 radially outer contact surface
82 radially inner contact surface
84 threaded portion
86 nut
88 retaining sleeve
90 structural component
92 coupling portion
94 actuating device
96 actuating ring
98 actuating trunnion
100 guide sleeve
102 edge portion

What is claimed is:

1. A connecting device for a variable vane of a gas turbine, the connecting device comprising:

a trunnion connected to a respective vane;

a lever connected to the trunnion, the lever and the trunnion being movable together about a trunnion axis of rotation (ZD);

wherein a clamp is provided and disposed between the lever and the trunnion establishing a frictional connection between the trunnion, the clamp and the lever; and the lever, the clamp and the trunnion are aligned with one another by a positioning element, the positioning element being accommodated in a trunnion receptacle formed in the trunnion and a lever receptacle formed in the lever, the positioning element directly contacting the lever receptacle and effecting alignment of the trunnion and the lever circumferentially relative to the trunnion axis of rotation.

2. The connecting device as recited in claim 1, wherein the clamp has a plurality of slots arranged along a circumference of the clamp such that an elastically flexible clamping portion is formed between respective adjacent slots.

3. The connecting device as recited in claim 2, wherein at least two diametrically opposite slots of the plurality of slots are dimensioned to form a clamping receptacle in which the positioning element is received.

4. The connecting device as recited in claim 2, wherein there are a plurality of clamping portions and each clamping portion is configured to have a conical outer contact surface.

5. The connecting device as recited in claim 2, wherein the lever has a sleeve-like coupling portion, wherein a contact surface of the coupling portion of the lever and contact surfaces of the clamping portions rest against each other and are clampable or clamped against one another.

6. The connecting device as recited in claim 1, wherein at least two diametrically opposite slots are provided in the clamp and are dimensioned to form a clamping receptacle in which the positioning element is received.

7. The connecting device as recited in claim 1, wherein the trunnion receptacle and the lever receptacle are disposed in alignment with one another.

8. The connecting device as recited in claim 1, wherein the trunnion receptacle is formed in an axial end portion of the trunnion.

9. The connecting device as recited in claim 1, wherein the lever receptacle is provided by two diametrically opposite lever receptacle sections.

10. The connecting device as recited in claim 1, wherein the lever has a sleeve-like coupling portion, the coupling portion and the trunnion being arranged concentrically relative to each other.

11. The connecting device as recited in claim 10, wherein the lever receptacle is formed in an axial edge portion of the coupling portion.

12. The connecting device as recited in claim 10, wherein the coupling portion has a radially inner contact surface that is conical in configuration.

13. The connecting device as recited in claim 10, wherein a retaining sleeve is disposed on the coupling portion in an axial direction (AR).

14. A gas turbine comprising a plurality of variable vanes disposed adjacent one another in the circumferential direction, each vane having disposed thereon a connecting device according to claim 1, wherein the levers of the connecting devices are coupled to an actuating ring that is movable along a circumferential direction of the gas turbine.

15. The gas turbine of claim 14, wherein the gas turbine is an aircraft gas turbine and the variable vanes are stator vanes.

16. The connecting device of claim 1, wherein the gas turbine is an aircraft gas turbine.

17. The connecting device of claim 1, wherein the positioning element does not transmit to the trunnion any rotational movements introduced by the lever.

18. The connecting device of claim 1, wherein the positioning element is a key fitting into the lever receptacle.

19. A connecting device for a variable vane of a gas turbine, the connecting device comprising:

a trunnion connected to a respective vane;

a lever connected to the trunnion, the lever and the trunnion being movable together about a trunnion axis of rotation (ZD);

wherein a clamp is provided and disposed between the lever and the trunnion establishing a frictional connection between the trunnion, the clamp and the lever; and the lever, the clamp and the trunnion are aligned with one another by a positioning element, the positioning element being accommodated in a trunnion receptacle formed in the trunnion and a lever receptacle formed in the lever, the positioning element effecting alignment of the trunnion and the lever circumferentially relative to the trunnion axis of rotation; and wherein the lever has a sleeve-like coupling portion, the coupling portion and the trunnion being arranged concentrically relative to each other and wherein a retaining sleeve is disposed on the coupling portion in an axial direction (AR).

20. A connecting device for a variable vane of a gas turbine, the connecting device comprising:

a trunnion connected to a respective vane;

a lever connected to the trunnion, the lever and the trunnion being movable together about a trunnion axis of rotation (ZD);

wherein a clamp is provided and disposed between the lever and the trunnion establishing a frictional connection between the trunnion, the clamp and the lever; and the lever, the clamp and the trunnion are aligned with one another by a positioning element, the positioning element being accommodated in a trunnion receptacle formed in the trunnion and a lever receptacle formed in the lever, the positioning element effecting alignment of the trunnion and the lever circumferentially relative to the trunnion axis of rotation;

wherein the positioning element does not transmit to the trunnion any rotational movements introduced by the lever.

* * * * *